US008474661B2

(12) United States Patent
Carta

(10) Patent No.: US 8,474,661 B2
(45) Date of Patent: Jul. 2, 2013

(54) DISPENSER OF FLUID PRODUCTS

(75) Inventor: Lamberto Carta, Pescara (IT)

(73) Assignee: Emsar S.p.A., San Giovanni Teatino (CH) (IT)

( * ) Notice: Subject to any disclaimer, the term of this patent is extended or adjusted under 35 U.S.C. 154(b) by 296 days.

(21) Appl. No.: 12/992,988

(22) PCT Filed: Apr. 21, 2009

(86) PCT No.: PCT/IT2009/000180

§ 371 (c)(1),
(2), (4) Date: Nov. 16, 2010

(87) PCT Pub. No.: WO2009/139015

PCT Pub. Date: Nov. 19, 2009

(65) Prior Publication Data

US 2011/0084099 A1 Apr. 14, 2011

(30) Foreign Application Priority Data

May 16, 2008 (IT) ..... RM2008A0263

(51) Int. Cl.
*B65D 37/00* (2006.01)
*B67B 1/00* (2006.01)

(52) U.S. Cl.
USPC ..... 222/153.13; 222/207

(58) Field of Classification Search
USPC ..... 222/207, 209, 212–215, 153.13
See application file for complete search history.

(56) References Cited

U.S. PATENT DOCUMENTS

| | | | | |
|---|---|---|---|---|
| 4,088,248 | A | 5/1978 | Blake | |
| 4,913,322 | A | 4/1990 | Stoffler et al. | |
| 4,915,601 | A * | 4/1990 | von Schuckmann | 417/472 |
| 5,664,703 | A * | 9/1997 | Reifenberger et al. | 222/207 |
| 6,547,106 | B2 * | 4/2003 | Bonningue | 222/213 |
| 6,712,243 | B2 * | 3/2004 | Rossignol | 222/207 |
| 7,624,897 | B2 * | 12/2009 | Bloc | 222/207 |
| 2003/0132252 | A1 | 7/2003 | Rossignol | |
| 2006/0273112 | A1 * | 12/2006 | Fuchs | 222/207 |

FOREIGN PATENT DOCUMENTS

| | | | |
|---|---|---|---|
| FR | 2127774 | A5 | 10/1972 |
| WO | 0191913 | A1 | 12/2001 |
| WO | 2009003974 | A2 | 1/2009 |
| WO | 2009047827 | A2 | 4/2009 |

OTHER PUBLICATIONS

International Search Report, dated Jul. 21, 2009, from corresponding PCT application.

* cited by examiner

*Primary Examiner* — Kevin P Shaver
*Assistant Examiner* — Nicholas J Weiss
(74) *Attorney, Agent, or Firm* — Young & Thompson

(57) ABSTRACT

A dispenser of fluid products includes a ring nut (2) able to be associated to a container of a fluid product and a substantially hollow dispensing head, able to slide coaxially relative to the ring nut (2); the dispensing head (8) includes a dosing chamber (14) obtained within the dispensing head (8) and a dispensing nozzle (12) to allow the outflow of the fluid product; the dosing chamber (14) has a containment volume variable between a configuration of maximum volumetric capacity when the dosing chamber (14) is isolated and a configuration of minimum volumetric capacity; the dispenser further includes a deformable membrane (15) fastened to the ring nut (2) and a deformable disc-shaped body (16) fastened to the dispensing head (8) and defining the dosing chamber (14) in combination with the membrane (15).

18 Claims, 4 Drawing Sheets

DISPENSER OF FLUID PRODUCTS

TECHNICAL FIELD

The present invention relates to a dispenser of fluid products. In particular, the present invention relates to a device for dosing and dispensing viscous fluid products, such as liquid soaps, lotions or the like contained in appropriate containers.

BACKGROUND ART

Dispensers of fluid products are known, which close on a container of a fluid product to be dispensed and, therefore, which also serve the function of closing cap for said containers.

Known dispensers comprise a variable volume dosing chamber for aspirating and subsequently dispensing a portion of the fluid product from the container.

In detail, when the volume of the dosing chamber is reduced, the overpressure thus produced expels outwards the portion of fluid portion contained therein, whilst when the volume of the dosing chamber is increased the vacuum thus created aspirates a subsequent portion of product from the container to the dosing chamber. Appropriate check valves regulate the flows described above.

Known dispensers comprise a closing ring nut able to be associated to a neck of the aforementioned container and a dispensing head slidably associated to the ring nut and able to be actuated manually by a user to obtain the dispensing of the product.

The dosing chamber is obtained between the ring nut and the dispensing head.

The dosing chamber is defined by a deformable membrane entirely contained within the dispenser and by the dispensing head. In particular, the membrane is connected to the dispensing head at a peripheral edge and it is fastened to the ring nut at its centre.

When the user actuates the dispensing head, the membrane is deformed in such a way as to reduce the volume of the dosing chamber to dispense the product.

When the user stops acting on the dispensing head, the membrane tends to return to its original shape, favouring the return of the dispensing heat to the original position.

In other words, the membrane also serves as a return elastic means.

Known devices also comprise intake and delivery valves that regulate the flow of the fluid product respectively into and out of the dosing chamber.

In detail, during a step of aspirating the fluid product into the dosing chamber, the intake valve opens to allow the inflow of the fluid into the chamber, whilst the delivery valve remains closed to prevent the product from flowing out of the dispensing nozzle. During a step of dispensing the fluid product, vice versa, the intake valve closes and prevents the product from flowing back into the container, whilst the delivery valve opens to allow it to flow out of the dispensing nozzle.

In known devices, the intake valve is defined by a central element that shuts off a passage port between the container and the dosing chamber and that can be integrated with the membrane itself. The central element houses in a corresponding seat and it is maintained in this position by the overpressure generated while dispensing the product, whereas it is moved away from the seat by the vacuum generated during the filling of the dosing chamber.

Typically, the membrane also defines the outflow valve in combination with the dispensing head. In other words, the membrane adheres along its own edge to the dispensing head, isolating the dosing chamber during its filling.

Disadvantageously, this type of dispenser is distinguished by a limited dispensing capacity.

In detail, the dispensing capacity directly depends on the difference between the maximum volume and the minimum volume of the dosing chamber which represents the volume actually ejected during the dispensing step. Similarly, the intake capacity is also reduced for the same reasons.

Since in known dispensers the dosing chamber presents a considerable minimum volume, the dispensing capacity and the intake capacity are limited and unsatisfactory.

An additional disadvantage of this type of dispensers is associated with the fact that the outflow valve is defined by the combination of the membrane with the dispensing head. During the dispensing step, the deformed membrane can occasionally partly obstruct the outflow of the product. This drawback is further reflected in the need for a greater force on the dispensing head to obtain the outflow of the product.

Additionally, among the disadvantages associated with known dispensers there is the impossibility of achieving a delay in the closure of the outflow valve to prevent the escape of drops of product from the nozzle after the completion of the dispensing operation.

Once the dispensing operation is concluded, a minimal portion of product remains in the dispensing nozzle and can fall outwards by gravity.

DISCLOSURE OF INVENTION

In this context, the technical task of the present invention is to propose a dispenser of fluid products that is free of the aforementioned drawbacks.

In particular, an object of the present invention is to propose a dispenser of fluid products that allows for an improved dispensing capacity.

Additionally, an object of the present invention is to propose a dispenser of fluid products that is easy and pleasant to use. Lastly, an object of the present invention is to propose a dispenser of fluid products that does not allow unwanted escapes of product. In accordance with the present invention, the technical task and the object described are achieved by a dispenser of fluid products comprising the technical characteristics set out in one or more of the accompanying claims.

DESCRIPTION OF THE DRAWINGS

Additional features and advantages of the present invention shall become more readily apparent from the indicative, and therefore not limiting, description of a preferred but not limiting embodiment of a dispenser of fluid products, as illustrated in the accompanying drawings in which.

DESCRIPTION OF THE ILLUSTRATIVE EMBODIMENT

Figure 1:
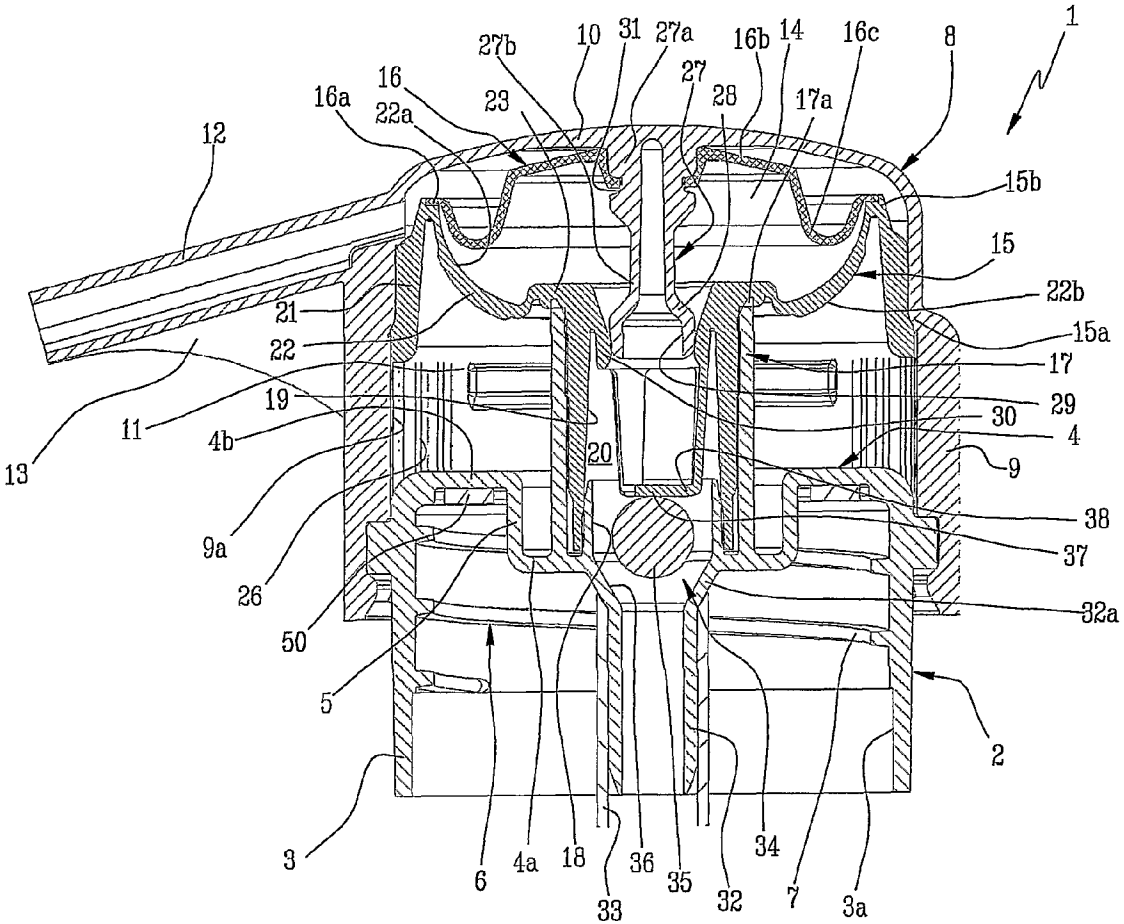
FIG. 1 shows a lateral sectioned view of a dispensers of fluid products in accordance with the present invention in a first operative configuration.

With reference to the accompanying figures, the number 1 indicates in its entirety a dispenser of fluid products in accordance with the present invention.

The dispenser 1 comprises a ring nut 2 able to be associated to a container of a fluid product (not shown) comprising a lateral cylindrical wall 3 and an annular wall 4 of the ring nut 2 to obstruct an access to the container.

The annular wall 4 of the ring nut 2 comprises an inner portion 4*a* and an outer portion 4*b*, both flat. The inner portion 4*a* and the outer portion 4*b* are parallel and lying on distinct planes. In particular, the inner portion 4*b* is fully contained in the cylindrical wall 3 of the ring nut 2. The inner portion 4*a* and the outer portion 4*b* are connected by means of a cylindrical connecting shoulder 5.

The ring nut 2 comprises coupling means 6 to fasten the ring nut 2 to the container. In the described embodiment, the coupling means 6 comprise a helical thread 7 obtained on an inner surface 3*a* of the cylindrical wall 3 of the ring nut 2. Said thread 7 can be coupled to a corresponding, not shown, thread of the container.

In an alternative embodiment, not shown, the association means 6 comprise a circular undercut that engages a groove obtained on the container.

The dispenser 1 further comprises a substantially hollow dispensing head 8, able to slide coaxially relative to the ring nut and made of rigid plastic material.

In detail, the dispensing head 8 comprises a cylindrical lateral wall 9 and a top wall 10 connected to the cylindrical wall 9 of the dispensing head 8 to define an inner compartment 11 of the dispensing head 8. In the described embodiment, the top wall 10 is cupola shaped.

The dispensing head 8 comprises a dispensing nozzle 12 to place in fluid communication an outer environment with the aforementioned compartment 11. Two reinforcing gables 13 are connected between the dispensing nozzle 12 and the cylindrical lateral wall 9 of the dispensing head 8 to provide the dispensing nozzle 12 with greater mechanical strength.

The dispensing head 8 further comprises a dosing chamber 14 obtained in the inner compartment 11. As shall become more readily apparent in the remainder of the present description, the dosing chamber 14 presents a containment volume that is variable according to the relative position between the dispensing head 8 and the ring nut 2. In particular, the containment volume of the dosing chamber 14 varies between a configuration of maximum volumetric capacity and a configuration of minimum volumetric capacity. More in particular, when the dosing chamber 14 assumes the configuration of maximum volumetric capacity, it is isolated from the outside environment.

The dispenser 1 further comprises a membrane 15 made of flexible and deformable plastic material and connected at least to the ring nut 2. Moreover, the dispenser 1 comprises a disc-shaped body 16 made of flexible, deformable plastic material and fastened at least to the dispensing head 8. the membrane 15 and the disc-shaped body 16 define, in mutual combination, said dosing chamber 14. In particular, the membrane 15 and the disc-shaped body 16 are fully contained in the dispensing head 8. Therefore, the dosing chamber 14 is fully contained in the dispensing head 8 and, in particular, in its inner compartment 11.

In the described embodiment, the membrane 5 and the disc-shaped body 16 present substantially axial-symmetric conformation and they face each other. In detail, the membrane 15 is superposed to the disc-shaped body 16 and it is positioned coaxially with respect to it.

The membrane 15 is also fastened to the dispensing 8 at a peripheral edge 15*a* of the membrane 15 in such a way that the relative motion between the dispensing head 8 and the ring nut 2 causes a deformation of the membrane 15.

The dispensing head 8 is movable between a first position in which the disc-shaped body 16 is distal from the membrane 15 and a second position in which the disc-shaped body 16 is proximal to the membrane 15.

Figure 2:
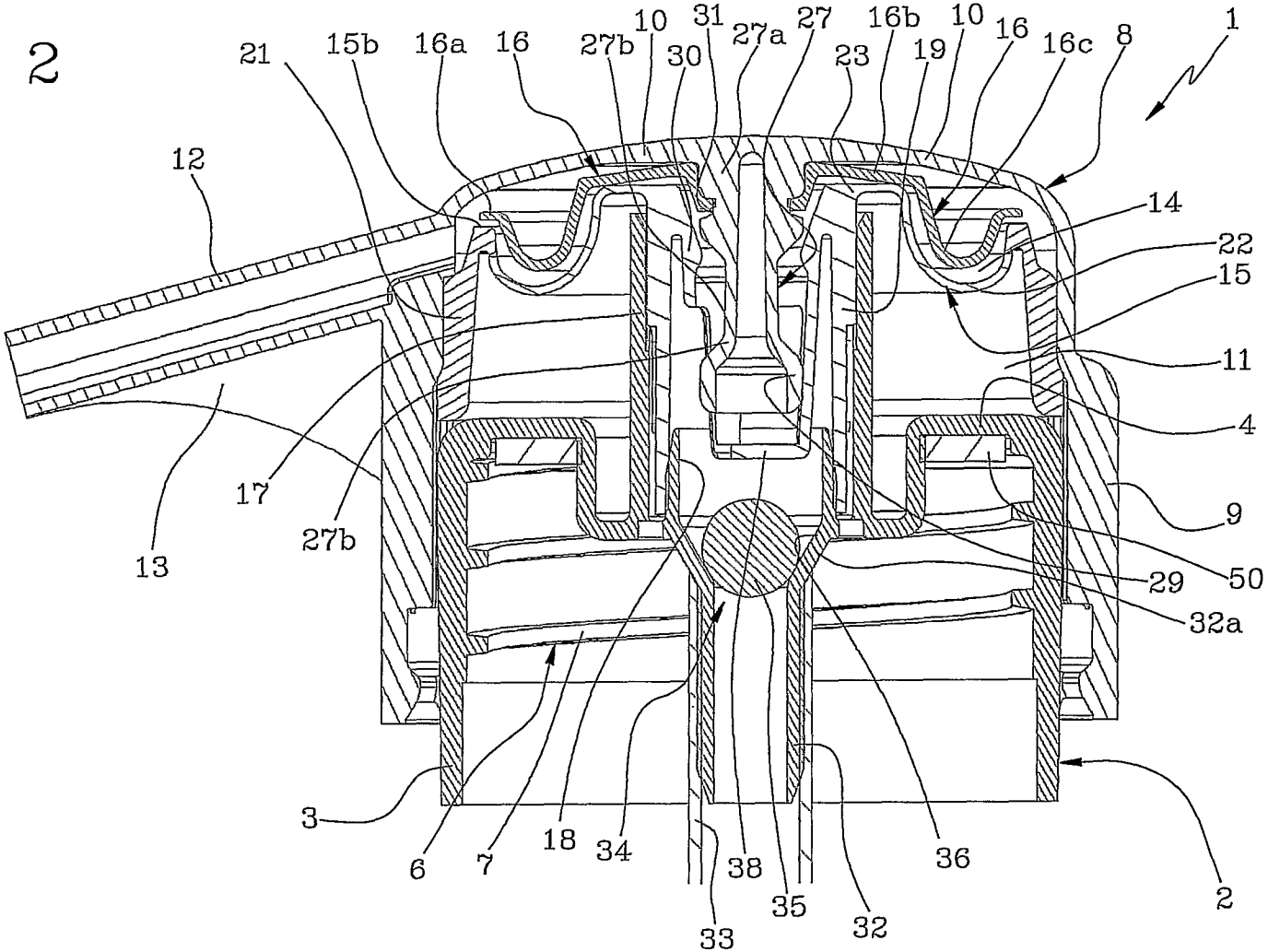
FIG. 2 shows a lateral sectioned view of the dispenser of FIG. 1 in a second operative configuration.

More precisely, when the dispensing head 8 assumes the first position (FIG. 1), the membrane 15 is not deformed and the dosing chamber 14 is in the configuration of maximum volumetric capacity, it is isolated and it is filled with the fluid. When the dispensing head 8 assumes the second position (FIG. 2), the membrane 15 is deformed and the dosing chamber 14 is in the configuration of minimum volumetric capacity.

In other words, when the dispensing head 8 is lowered by a user from the first to the second position, the dosing chamber 14 decreases its own volume, thereby causing an overpressure that determines the dispensing of the fluid product.

When, on the contrary, the dispensing head 8 is lifted from the second to the first position, the volume of the dosing chamber 14 increases and the vacuum that is thus caused determines the filling of the dosing chamber 14.

During the passage from the first to the second position of the dispensing head 8, both the membrane 15 and the disc-shaped body 16 progressively pass from respective non deformed configurations to respective deformed configurations. It should be noted that said actuation is provided by the user who presses the dispensing head 8.

Similarly, during the passage from the second to the first position of the dispensing head 8, both the membrane 15 and the disc-shaped body 16 progressively pass from the deformed configurations to the non deformed configuration by elastic return of the membrane 15.

When the dispensing head 8 is in the first position, an upper edge 15*b* of the membrane 15 lies in fluid-tight contact with a lateral edge 16*a* of the disc-shaped body 16. In this way, the isolation of the dosing chamber 14 is achieved.

When the dispensing head 8 is pressed to pass from the first to the second position, the membrane 15 deforms and its upper edge 15*b* moves away from the disc-shaped body 16 such as to place in fluid communication the dosing chamber with the outside environment through the dispensing nozzle 12.

In other words, the disc-shaped body 16 defines in cooperation with the membrane 15 an outflow valve for the dispensed fluid.

As mentioned above, the membrane 15 is connected to the ring nut 2.

For this purpose, the ring nut 2 comprises a cylindrical segment 17 positioned coaxially to the same ring nut 2 and defines a connecting seat with the membrane 15.

More in detail, the cylindrical segment 17 extends from the annular wall 4 of the ring nut 2 towards the dispensing head 8.

The ring nut 2 further comprises a cylindrical band 8, coaxially and internal to the cylindrical segment 17 that develops starting from the annular wall 4 of the ring nut 2 towards the dispensing head 8. The length of the cylindrical segment 17 is greater than the length of the cylindrical band 18.

The membrane 15 comprises a tubular segment 19 positioned coaxial to a central axis "A" of the membrane 15 and fastened coaxially to the cylindrical segment 17 of the ring nut 2.

More in detail, the tubular segment 19 is inserted within the cylindrical segment 17 so that a free end 19*a* of the tubular segment 19 lies in the space between the cylindrical segment 17 and the cylindrical band 18. It should be noted that said free end 19*a* presents a thinned section to facilitated the assembly of the membrane 15 on the ring nut 2 when mounting the dispenser 1.

In this way, the connection between the membrane 15 and the ring nut 2 is achieved.

As shall become more readily apparent below, the tubular segment 19 defines a conduit 20 for the passage of the fluid from the container to the dosing chamber 14.

The membrane 15 is also connected to the dispensing head 8. For this purpose, the membrane 15 comprises a peripheral band 21 connected with interference to an inner surface 9*a* of the lateral cylindrical wall 9 of the dispensing head 8.

The membrane 15 further comprises a curved portion 22 connected to the peripheral band 21 in proximity to the upper edge 15*b* of the membrane 15. The curved portion 22 in turn is connected to the tubular segment 19.

More in particular, the membrane 15 comprises a flat annular wall 23 positioned between the curved portion 22 and the tubular segment 19. The annular wall 23 of the membrane 15 abuts on a free end 17*a* of the cylindrical segment 17.

The curved portion 22 of the membrane 15 presents a concave inner surface 22*a*. Said inner surface 22*a* is then oriented towards the interior of the dosing chamber 14.

Figure 5:
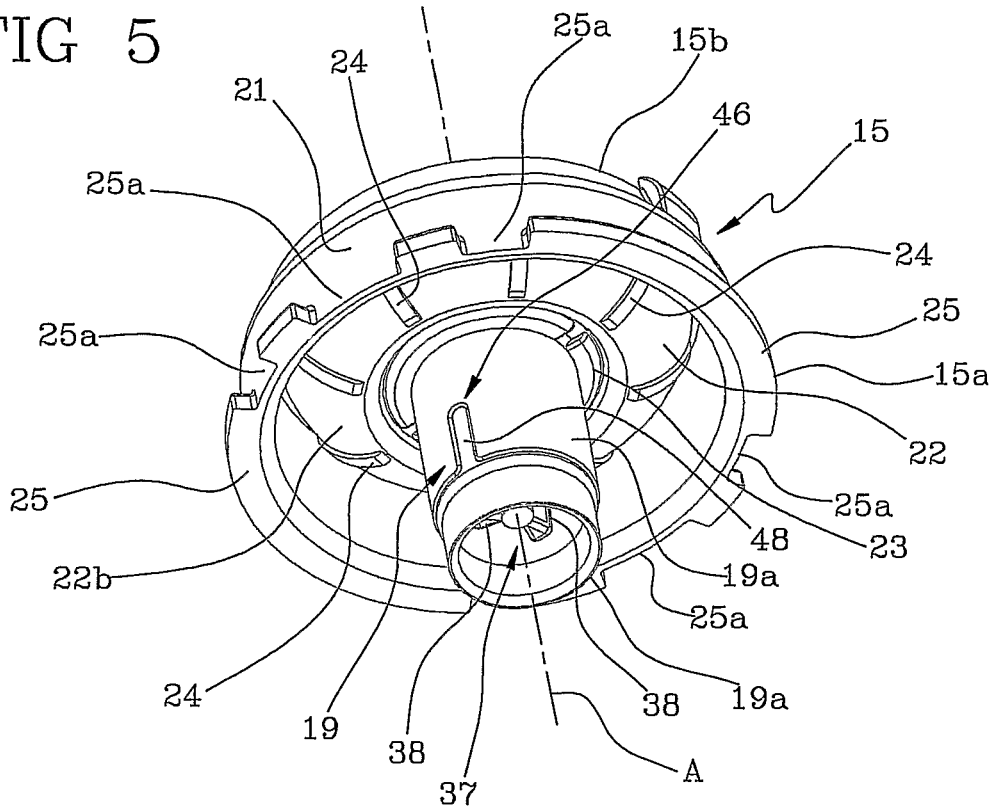
FIG. 5 shows a perspective view of a second component of the dispenser of FIG. 1.

The membrane 15 further comprises a plurality of radial ribs 24 (FIG. 5). They are positioned between an outer surface of the membrane 15. More in detail, the ribs 24 are arranged radially on an outer surface 22*b* of the curved portion 22 of the membrane 15. Said ribs 24 stiffen the curved portion in such a way that the elastic return of the membrane 15 is more effective and the membrane 15, once deformed, returns more easily to its non deformed configuration.

The membrane 15 and the dispensing head 8 are also fastened in rotation. In other words, the membrane 15 and the dispensing head 8 are mutually coupled in such a way as to assure that one rotates integrally with the other.

For this purpose, the membrane 15 comprises a circular flange 25 that extends at the base of the peripheral band 21. In detail, the flange 25 achieves a contact by interference with the inner surface 9*a* of the lateral cylindrical wall 9 of the dispensing head 8.

The flange 25 presents a plurality of interruptions 25*a* in which are housed successive pairs of rectilinear ribs 26 obtained on the inner surface 9*a* of the cylindrical wall 9 of the dispensing head 8 (FIG. 5). In other words, the flange 25 is complementarily shaped relative to ribs 26 in order to achieve a rotational bond between the membrane 15 and the dispensing head 8.

As stated above, the disc-shaped body 16 is connected to the dispensing head 8, and in particular to the top wall 10.

The disc-shaped body 16 comprises a substantially cone frustum shaped central portion 16*b* and a peripheral portion 16*c*, directly connected to the central portion 16*b*, having curved section with its convexity oriented towards the dosing chamber 14.

More precisely, the cone frustum shaped central portion 16*b* develops with a predetermined angle of aperture and it presents its concavity substantially oriented towards the dosing chamber 14. The peripheral portion 16*c* instead is constituted by a substantially "U" shaped section and revolving around a central axis of the disc-shaped body 16. The lateral edge 16*a* of the disc-shaped body 16 is thus obtained on the peripheral portion 16*c*.

When the dispensing head 8 passes from the second to the first position to perform the filling of the dosing chamber 14, the lateral edge 16*a* of the disc-shaped body 16 returns in contact with the upper edge 15*b* of the membrane 15 with a predetermined delay.

This enables, advantageously, the exert a limited aspiration of the portion of fluid contained in the dispensing nozzle 12 that therefore is emptied. In this way, the fall of fluid outside the dispensing nozzle 12 by gravity is prevented.

The duration of the delay with which the disc-shaped body 16 returns in contact with the membrane 15, thus isolating the dosing chamber 14, is a function of said predetermined angle of aperture of the inner cone frustum shaped inner portion 16*b* of the disc-shaped body 16.

The disc-shaped body 16 is connected at the centre of the top wall 10 of the dispensing head 8.

More in detail, the dispensing head 8 comprises a pivot pin 27 that develops inside the dosing chamber 14 coaxially to a central axis of the dispensing head 8.

The pivot pin 27 presents a proximal end 27*a* to the dispensing head 8 in proximity of which it is fastened to the latter, and a distal end 27*b* to the dispensing head 8.

The pivot pin 27 comprises a diverging body 28 positioned at its distal end 27*b*. The diverging body 28 defines a closure element 29 able to occlude the conduit 20 when the dosing chamber 14 assumes the configuration of maximum volumetric capacity. With greater detail, the closure element 29 completes the isolation of the dosing chamber 14 in its configuration of maximum volumetric capacity. More in detail, the closure element 29 completes the isolation of the dosing chamber 14 in its configuration of maximum volumetric capacity. In other words, the closure element 29 occludes the conduit 20 when the dispensing head 8 is in the described first position.

The tubular segment 19 comprises a ring 30, coaxial and internal to the tubular segment 19 itself. More in detail, the ring 30 develops in proximity to the annular wall 23 of the membrane 15 towards the free end 19*a* of the tubular segment 19.

The ring 30 is to come in fluid-tight contact with the closure element 29 in order to achieve the occlusion of the conduit 20 and the isolation of the dosing chamber 14.

When the dispensing head 8 is lowered and the fluid dispensing operation is taking place, the closure element 29 of the pivot pin 27 descends integrally with the dispensing head 8, disengages from the ring 30 and opens the conduit 20.

Moreover, the pivot pin 27 presents a circumferential groove positioned at its proximal end 27*a*. Said groove 31 is able to house the disc-shaped body 16 at its central hole. In this way, the connection between the disc-shaped body 16 and the dispensing head 8 is achieved.

The dispensing body 1 further comprises a sleeve 32 constructed in a single piece with the ring nut 2 and positioned coaxially to the ring nut 2 itself. A suction tube 33, which lies immersed in the fluid contained in the container, is inserted outside the sleeve 32.

The sleeve 32 is positioned in such a way as to be fully enveloped by the lateral cylindrical wall 3 of the ring nut 2.

The sleeve 32 is in direct fluid communication with the conduit 20 defined by the tubular segment 19 in such a way that the fluid drawn from the container transits through the suction tube 33 and the tubular segment 19 into the dosing chamber 14.

The dispenser 1 further comprises an inflow valve 34 that regulates the inflow of fluid into the dosing chamber 14. The inflow valve 34 is obtained at least in part in the ring nut 2 and in particular at the annular wall 4 of the ring nut 2.

The inflow valve 34 comprises a ball 35 positioned in a housing seat 36 that is defined by a cone frustum shaped portion 32*a* of the sleeve 32. Said cone frustum shaped portion 32*a* is directly connected to the annular wall 4 of the ring nut 2. More in detail, the cone frustum shaped portion 32*a* is directly connected to the inner portion 4*a* of the annular wall 4 of the ring nut 2.

The inflow valve 34 can thus be configured between an open configuration in which it allows the transit of the fluid during the intake and filling of the dosing chamber 14 and a closed configuration assumed during the dispensing operation.

In the illustrated embodiment, the ball 35 is floating. In other words, the ball 35 is made of plastic material (e.g., polyolefins) having lower density than most of the dispensed fluids. In this way, the inflow valve 34 is normally opened in the presence of the fluid. In other words, when the dispensing head 8 is in the first position and the dosing chamber 14 assumes the configuration of maximum volumetric capacity, the inflow valve 34 is open. However, it should be stressed that in this case, the dosing chamber 14 is full of fluid to be dispensed and it is isolated from the inflow valve 34 because the conduit 20 is occluded by the closure element 29.

When the dispensing head 8 is lowered and the dispensing operation is taking place, as stated, the conduit 20 opens because the closure element disengages the ring 30. However, the overpressure generated in this step thrusts the ball 35 towards the cone frustum shaped portion 32*a* until it comes in contact therewith, in such a way as to close the inflow valve 34.

The inflow valve 34 further comprises at least one stop 37 positioned inside the tubular segment 19 of the membrane 15 and at the housing seat 36 to limit the travel of the ball 35 when the inflow valve 34 is open and the ball 35 floats.

In the described embodiment, the stop 37 is constituted by an extension 38 that extends starting from the ring 30 towards the cone frustum shaped portion 32*a*. In the described embodiment, there are three extensions 38 that are obtained in a single piece with the membrane 15.

Figure 3:
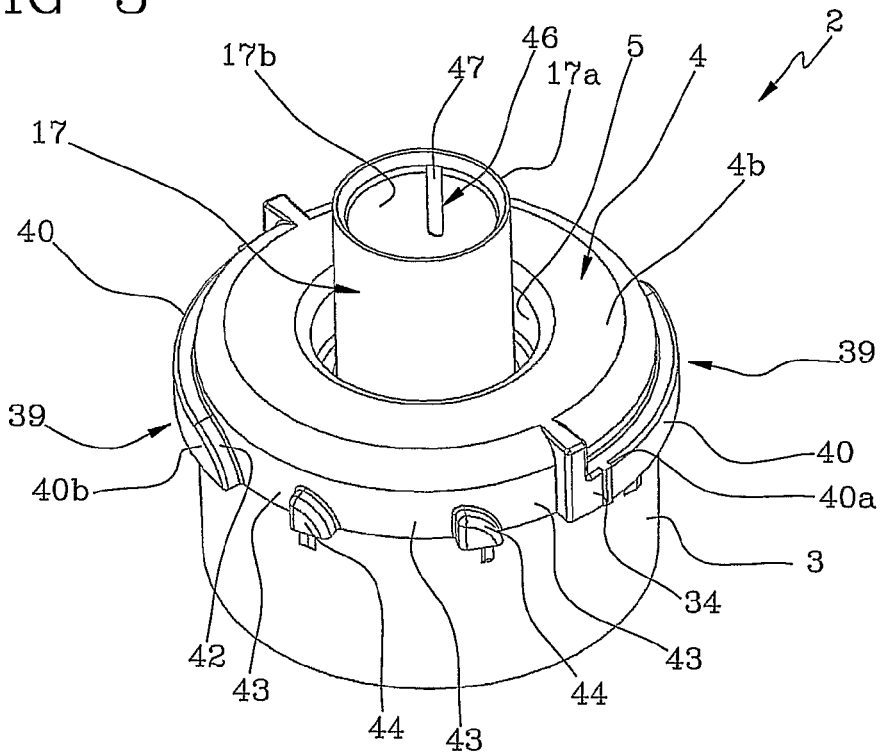
FIG. 3 shows a perspective view of a first component of the dispenser 1.
Figure 6:
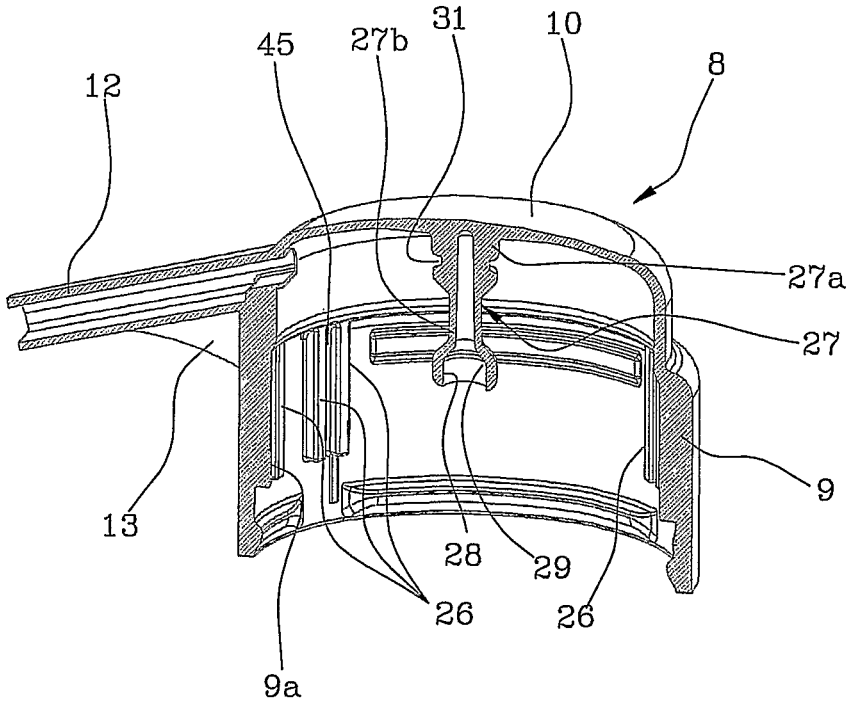
FIG. 6 shows a perspective sectioned view of a third component of the dispenser of FIG. 1.

The dispenser 1 further comprises locking means 39 to prevent involuntary actuations of the dispenser 1 (FIGS. 3 and 6).

Said locking means 39 comprise a plurality of circumference arc protrusions 40 positioned on the cylindrical wall 3 of the ring nut 2 (FIG. 3). Each protrusion 40 comprises a locking appendage 41, positioned at its first end 40*a*, and a rounded appendage 42, positioned at its second end 40*b*.

When the locking means 39 are active, lower ends 26*a* of the ribs 26 abut on the protrusions 40 to prevent the dispensing head 8 from being lowered relative to the ring nut 2.

To deactivate the locking means 39, the user rotates the dispensing head 8 until the ribs 26 reach corresponding openings 43 defined between two successive protrusions 40. In this way, the dispensing head 8 can be lowered to dispense the fluid product.

In this case, a plurality of projections 44 obtained between the aforementioned openings 43 is inserted into the corresponding pairs of ribs 26 between which are defined respective sliding guides 45 for the projections 44.

Each locking appendage 41 of the protrusions 40 prevents the ribs 26 from overtaking the corresponding protrusion 40, inadvertently deactivating the locking means 39.

The rounded appendages 42, on the contrary, facilitate access to the openings 43 of the ribs 26 when the user wants to deactivate locking means 39.

Figure 4:
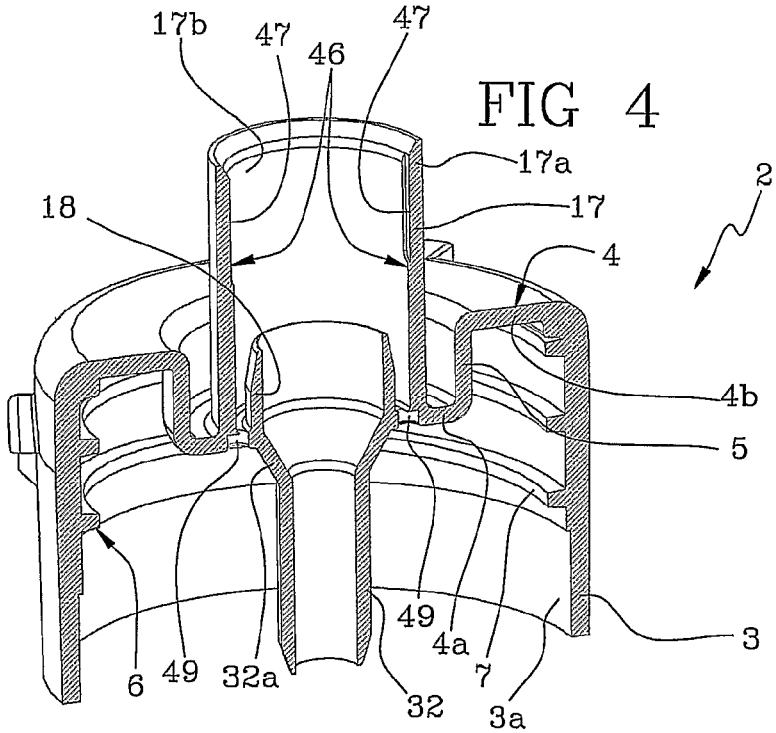
FIG. 4 shows a perspective sectioned view of the component of FIG. 3.

The dispenser 1 further comprises means 46 for compensating pressure, to maintain the pressure within the container constant and equal to atmospheric pressure (FIGS. 3, 4 and 5).

During the aspiration of the fluid product into the dosing chamber 14, a flow of air is introduced into the container to compensate for the drawn volume of fluid product.

For this purpose, on the inner surface 17*b* of the cylindrical segment 17 of the ring nut 2 is obtained at least one longitudinal recess 47 that extends from the free end 17*a* of the cylindrical segment 17 towards the annular part 4 of the ring nut 2 at least partially along said inner surface 17*b*.

In the described embodiment, there are two recesses 47 positioned diametrically opposite each other.

Similarly, on the outer surface 19*b* of the tubular segment 19 of the membrane 15 is obtained at least one corresponding longitudinal groove 48 that extends starting from the free end 19*a* of the tubular segment 19 towards the dispensing head 8 at least partially along said outer surface 19*b*. In the described embodiment, there are two grooves 48 positioned diametrically opposite each other.

Lastly, in the annular wall 4 of the ring nut 2 are obtained through holes 49 that define in combination with said grooves 48 and said recesses 47 the aforesaid compensating means 46.

More precisely, when the locking means 39 are inactive and the dispensing head 8 can be lowered to dispense the fluid, the recesses 47 of the cylindrical segment 17 and the grooves 48 of the tubular segment 19 face each other and allow a direct fluid communication through the holes 49 between the container and the outside environment to allow the inflow of the air necessary to compensate the volume of product dispensed. When the locking means 39 are activated and, therefore, the dispensing head 8 and the membrane 15 are rotated, the recesses 47 of the cylindrical segment 17 and the grooves 48 of the tubular segment 19 are offset and they no longer face each other and the fluid communication between the container and the outside environment is interrupted to prevent involuntary escapes of fluid.

The dispenser 1 further comprises a gasket 50 positioned at a lower surface 4*a* of the annular wall 4 of the ring nut 2 to prevent unwanted escapes of fluid product from the container.

The invention achieves the proposed objects and provides important advantages. Since the dosing chamber of the dispenser is defined by the membrane in combination with the disc-shaped body, the dosing chamber reaches a very small minimum value. In this way, the dispensing and aspirating capacity can be increased significantly.

In this way, use of the dispenser according to the present invention is more convenient, since for the same quantity of dispensed fluid a smaller force needs to be applied on the dispensing head.

Additionally, during the dispensing operation the membrane and the disc-shaped body are separated and the membrane is not able to obstruct the dispensation of the fluid. Consequently, this advantage is reflected in the need for a smaller force to actuate the dispenser, which appears more comfortable and easier to use.

Lastly, the possibility of introducing a delay in the closure of the disc-shaped body on the membrane during the aspiration allows, advantageously, to aspirate a residual portion of fluid contained in the dispensing nozzle, preventing unwanted escapes of product.

Additionally, an object of the present invention is to propose a dispenser of fluid product that is easy and pleasant to use. Lastly, an object of the present invention is to propose a dispenser of fluid products that does not allow unwanted escapes of product.

The invention claimed is:

1. Dispenser of fluid products comprising a ring nut (2) able to be associated to a container of a fluid product; a substantially hollow dispensing head (8) able to slide coaxially relative to said ring nut (2); said dispensing head (8) comprising a dosing chamber (14) obtained inside said dispensing head (8) and a dispensing nozzle (12) to allow the outflow of said fluid product; said dosing chamber (14) having a containment volume that can vary between a configuration of maximum volumetric capacity when said dosing chamber (14) is isolated and a configuration of minimum volumetric capacity; said dispenser being characterised in that it further comprises a deformable membrane (15) fastened to said ring nut (2) and a deformable disc-shaped body (16) fastened to said dispensing head (8) and defining said dosing chamber (14) in combination with said membrane (15); wherein said membrane (15) presents an upper edge (15*b*) in contact with a lateral edge (16*a*) of said disc-shaped body (16) when said dispensing head (8) is in said first position to isolate said dosing chamber (14); said upper edge (15*b*) being moved away from said lateral edge (16*a*) of said disc-shaped body (16) during a passage from said first position to said second position of said dispensing head (8) to allow fluid communication between said dosing chamber (14) and said dispensing nozzle (12).

2. Dispenser as claimed in claim 1, characterised in that said dispensing head (8) is movable between a first position in which the disc-shaped body (16) is distal from said membrane (15) and said dosing chamber (14) assumes said configuration of maximum volumetric capacity and a second position in which the disc-shaped body (16) is proximal to said membrane (15) and said dosing chamber (14) assumes said configuration of minimum volumetric capacity.

3. Dispenser as claimed in claim 1, characterised in that said membrane (15) comprises a tubular segment (19) for coupling with said ring nut (2); said tubular segment (19) defining a conduit (20) for the passage of said fluid from said container to said dosing chamber (14).

4. Dispenser as claimed in claim 3, characterised in that it further comprises a closure element (29) that occludes said conduit (20) when said dosing chamber (14) is in said configuration of maximum volumetric capacity to prevent the transit of said fluid.

5. Dispenser as claimed in claim 4, characterised in that said dispensing head (8) comprises a pivot pin (27) developing in said dosing chamber (14), said pivot pin (27) comprising a diverging body (28) positioned at its distal end (27*b*) from the dispensing head (8) to define said closure element (29).

6. Dispenser as claimed in claim 4, characterised in that said tubular segment (19) comprises a ring (30) that is coaxial and internal to said tubular segment (19), said ring (30) being able to come in contact with said closure element (29) to achieve the closure of said conduit (20).

7. Dispenser as claimed in claim 5, characterised in that said disc-shaped body (16) is connected to said pivot pin (27) at its proximal end (27*a*) to said dispensing head (8).

8. Dispenser as claimed in claim 1, characterised in that said disc-shaped body (16) comprises a cone frustum shaped central portion (16*b*) having a predetermined angle of aperture and a peripheral portion (16*c*) with curved section having convexity oriented towards said dosing chamber (14).

9. Dispenser as claimed in claim 1, characterised in that said membrane (15) comprises a peripheral band (21) extending from said upper edge (15*b*) and integrally associated to said dispensing head (8).

10. Dispenser as claimed in claim 1, characterised in that it further comprises a sleeve (32) rigidly fastened to said ring nut (2), said sleeve (32) being able to support a suction tube (33), and an inflow valve (34) able to regulate the transit of said fluid into said dosing chamber (14).

11. Dispenser as claimed in claim 10, characterised in that said inflow valve (34) comprises a ball (35) able to be housed in a housing seat (36) defined at least in part by a cone frustum shaped portion (32*a*) of said sleeve (32).

12. Dispenser as claimed in claim 11, characterised in that it comprises a stop (37) positioned within a tubular segment (19) of said deformable membrane (15) at said housing seat (36) to limit the travel of said ball (35).

13. Dispenser as claimed in claim 12, characterised in that said stop (37) comprises an extension (38) obtained in a single piece with said ring (30).

14. Dispenser as claimed in claim 1, characterised in that it further comprises locking means (39) active on the dispensing head (8) to prevent involuntary movements of said dispensing head (8).

15. Dispenser as claimed in claim 14, characterised in that said locking means (39) comprise a plurality of circumference arc protrusions (40) positioned on a cylindrical wall (3) of the ring nut (2) and a plurality of openings (43) defined between two successive protrusions (40).

16. Dispenser as claimed in claim 15, characterised in that it further comprises at least one pair of rectilinear ribs (26) positioned on an inner surface (9*a*) of a cylindrical wall (9) of said dispensing head (8); lower ends (26*a*) of said ribs (26) abutting on said protrusions (40) in a configuration of activation of the locking means (39); said lower ends (26*a*) of said ribs (26) lying at said openings (43) in a configuration of deactivation of the locking means (39).

17. Dispenser as claimed in claim 1, characterised in that it further comprises compensating means (46) to maintain the pressure within the container constant and equal to atmospheric pressure following a dispensation of the fluid.

18. Dispenser as claimed in claim 17, characterised in that said compensating means (46) comprise at least one longitudinal recess (47) obtained on an inner surface (17*b*) of a cylindrical segment (17) of said ring nut (2) and at least one corresponding longitudinal groove (48) obtained on an outer surface (19*b*) of a tubular segment (19) of the membrane (15), said groove (48) being able to face said recess (47) to allow a fluid communication between said container and an outside environment.

* * * * *

UNITED STATES PATENT AND TRADEMARK OFFICE

CERTIFICATE OF CORRECTION

PATENT NO. : 8,474,661 B2
APPLICATION NO. : 12/992988
DATED : July 2, 2013
INVENTOR(S) : Lamberto Carta It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 297 days.

Signed and Sealed this
Eighth Day of September, 2015

Michelle K. Lee

Michelle K. Lee
*Director of the United States Patent and Trademark Office*